US010000912B2

(12) United States Patent
Van Goor et al.

(10) Patent No.: US 10,000,912 B2
(45) Date of Patent: Jun. 19, 2018

(54) FREEZE PREDICTION SYSTEM

(71) Applicant: Honeywell International Inc., Morris Plains, NJ (US)

(72) Inventors: Nicolaas A. Van Goor, Edina, MN (US); Thomas Rosback, Chaska, MN (US); Marc Light, Saint Paul, MN (US)

(73) Assignee: Honeywell International Inc., Morris Plains, NJ (US)

( * ) Notice: Subject to any disclaimer, the term of this patent is extended or adjusted under 35 U.S.C. 154(b) by 0 days. days.

(21) Appl. No.: 15/183,580

(22) Filed: Jun. 15, 2016

(65) Prior Publication Data

US 2017/0362801 A1 Dec. 21, 2017

(51) Int. Cl.
*E03B 7/12* (2006.01)
*F24D 19/10* (2006.01)

(52) U.S. Cl.
CPC ..... *E03B 7/12* (2013.01); *F24D 19/10* (2013.01); *Y10T 137/1189* (2015.04)

(58) Field of Classification Search
CPC ..... E03B 7/12; F24D 19/10; Y10T 137/1189
See application file for complete search history.

(56) References Cited

U.S. PATENT DOCUMENTS 4,672,990 A * 6/1987 Robillard ..... E03B 7/12 126/588
4,848,389 A * 7/1989 Pirkle ..... E03B 7/10 137/357
5,220,937 A * 6/1993 Roberts ..... E03B 7/12 122/504
5,240,179 A * 8/1993 Drinkwater ..... E03B 7/12 137/59
5,318,059 A * 6/1994 Lyons ..... E03B 7/12 137/340
5,676,182 A * 10/1997 McMullen, Jr. ..... E03B 7/12 137/240
6,196,246 B1 * 3/2001 Folsom ..... E03B 7/12 122/504
6,622,930 B2 * 9/2003 Laing ..... E03B 7/12 137/59
6,981,848 B1 * 1/2006 Cessac ..... F04B 49/02 137/13

(Continued)

*Primary Examiner* — Craig Schneider
*Assistant Examiner* — Kevin Barss
(74) *Attorney, Agent, or Firm* — Seager, Tufte & Wickhem, LLP

(57) ABSTRACT

A freeze prediction system for components such as one or more water pipes situated in a building. The building may have a heating system, a mechanism with a temperature setting connected to the heating system, and an indoor temperature indicator connected to the thermostat. A call may be made for heat if thermostat setting is greater than an indoor temperature. A check may be made as to whether a call for heat may be answered. Outdoor conditions may be read and accounted for in the system. An expected time may be calculated of a freeze danger. One may determine whether the freeze danger is significant according to the expected time of freeze danger compared to a predetermined time. If the freeze danger is not significant, a regular equipment failed alert may be sent out. If the freeze danger is significant, a pipe freeze warning alert may be sent out.

15 Claims, 2 Drawing Sheets

(56) References Cited

U.S. PATENT DOCUMENTS

| | | | | |
|---|---|---|---|---|
| 7,185,508 | B2 * | 3/2007 | Voglewede | F25C 1/10 249/127 |
| 7,752,106 | B1 | 7/2010 | Corby et al. | |
| 8,008,603 | B2 * | 8/2011 | MacKenzie | F22B 37/42 122/13.01 |
| 8,833,384 | B2 * | 9/2014 | Burt | F24F 11/008 137/487.5 |
| 2011/0314851 | A1 * | 12/2011 | Kinoshita | F24F 11/0009 62/156 |
| 2014/0319231 | A1 * | 10/2014 | Matsuoka | G05D 22/02 236/51 |
| 2017/0058494 | A1 * | 3/2017 | Haun, Sr. | E03B 7/12 |

* cited by examiner

FREEZE PREDICTION SYSTEM

BACKGROUND

The present disclosure pertains to weather and heating conditions and particularly to predicting freeze conditions in a building.

SUMMARY

The disclosure reveals a freeze prediction system for components such as one or more pipes situated in a building. There may be a heating system for the building, a thermostat having a temperature setting connected to the heating system, and an indoor temperature indicator connected to the thermostat. A call may be made for heat if thermostat setting is more than an indoor temperature on the temperature indicator. A check may be made as to whether a call for heat is answered. Outdoor conditions may be read and taken into account. An expected time may be calculated of freeze danger from the thermostat setting, indoor temperature and outdoor conditions. Other factors may be noted. One may determine if the freeze danger is significant according to the expected time of freeze danger compared to a predetermined time. A predetermined time may be empirically or theoretically calculated. If the freeze danger is not significant, then a regular equipment failed alert may be sent out. If the freeze danger is significant, then a pipe freeze warning alert may be sent out.

DESCRIPTION

The present system and approach may incorporate one or more processors, computers, controllers, user interfaces, wireless and/or wire connections, and/or the like, in an implementation described and/or shown herein.

This description may provide one or more illustrative and specific examples or ways of implementing the present system and approach. There may be numerous other examples or ways of implementing the system and approach.

A significant number of home insurance claims each year are for water damage due to frozen water pipe incidents. The present system and approach may reduce a number of frozen water pipe incidents. Connected thermostats may detect when heating equipment fails. This knowledge, combined with indoor temperature measurements, current and/or future outdoor weather conditions may allow a prediction of the possibility of water pipes freezing provided that the measurements and conditions permit an occurrence of freezing. Knowledge of the thermal properties of buildings may result in better accuracy; however, they are not necessarily needed for initial predictions. Features of the present system over previous systems may permit higher accuracy through the use of predictive models, an ability to predict an urgency of an issue of water pipes, sending a smart alert to a contractor, if the contractor is on a contractor portal, a smart alert to a consumer, through email, Lyric app, SMS, and so forth.

Figure 1:
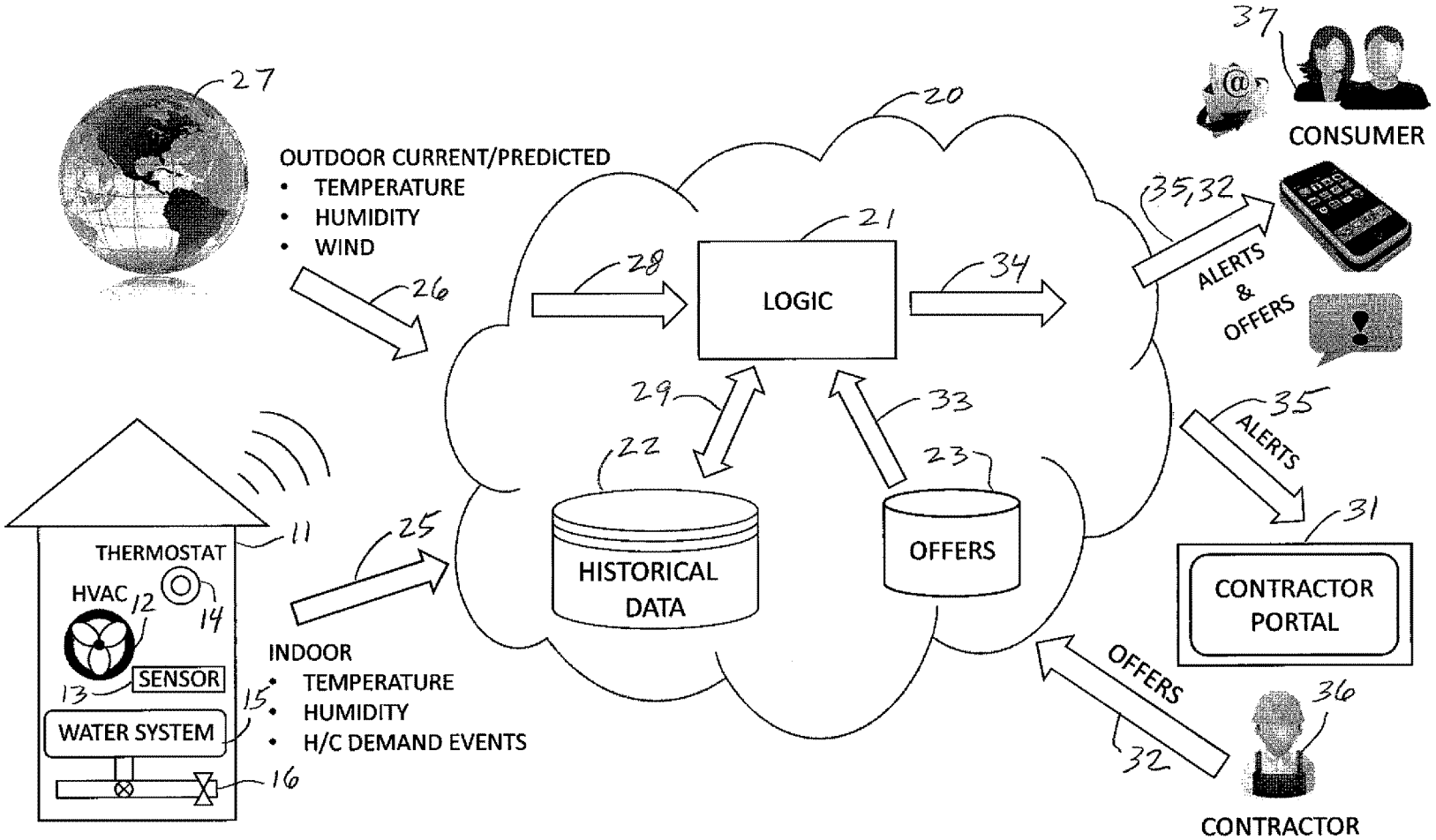
FIG. 1 is a diagram of an overview layout of a context for the present system and approach.
Figure 2:
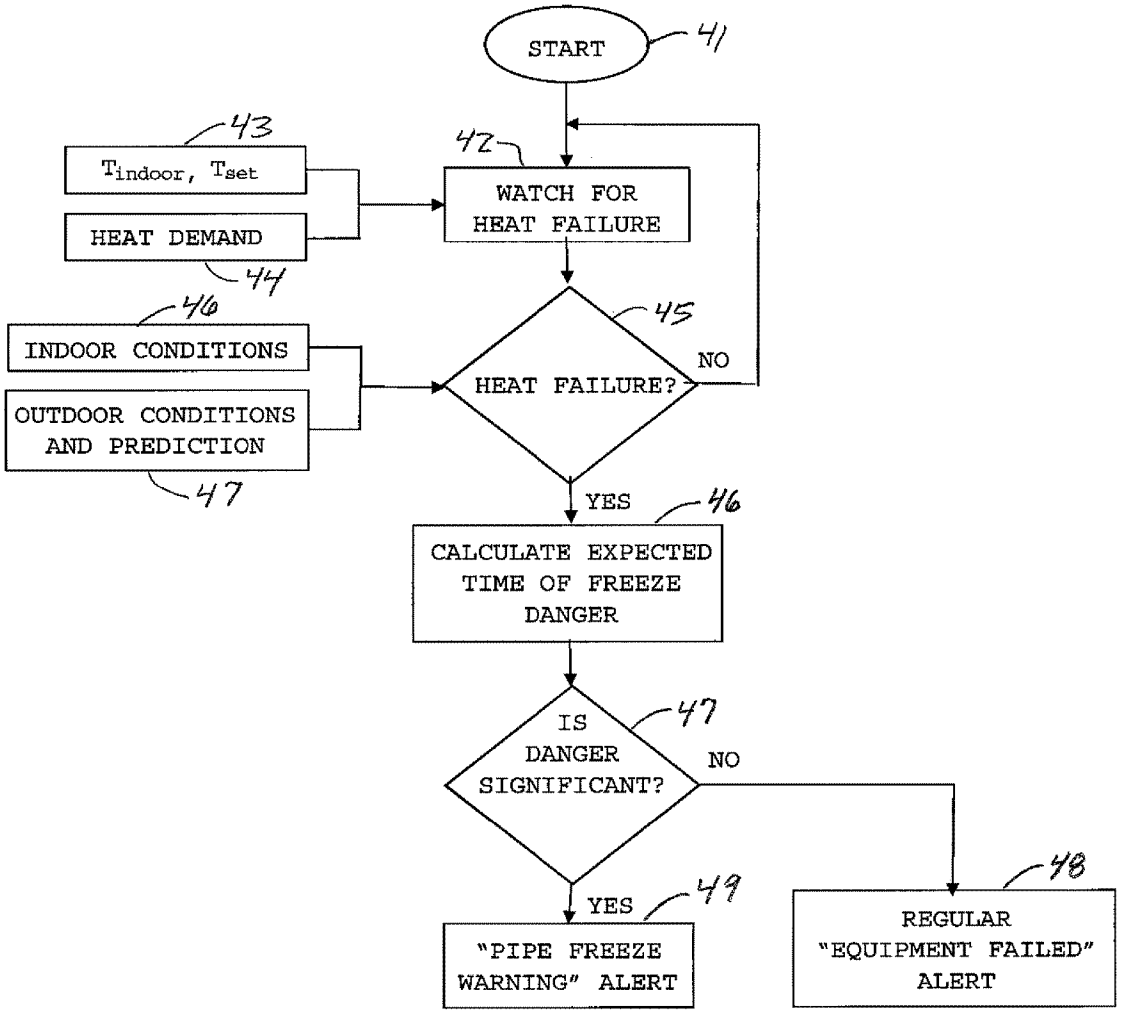
FIG. 2 is a diagram of a workflow that may predict detect a freeze condition.

A smart alert may include offers from contractors. FIG. 1 and FIG. 2 are diagrams that illustrate data about indoor temperature, temperature set-points, and heat demand sent regularly from thermostats to a cloud infrastructure that a company providing the system may maintain. This data stream may be monitored using known streaming analytics technologies. The monitoring may look specifically for situations where the thermostat is demanding heat from the furnace, but the temperature remains significantly below the heat set point (or is even dropping, despite heat demand). This may indicate furnace failure.

If furnace failure is detected, the logic moves to the next step, which is to determine whether there is a danger of freezing temperatures in the building. For this we use algorithms that may predict how fast the building will lose temperature, given external weather conditions.

If it is determined that it is likely that the indoor temperature will drop below a certain threshold, a "freeze alert" may be generated.

Depending on user settings, this alert may be sent to the building owner, via numerous channels (e.g., SMS, smartphone app, and/or email), or to other third parties, as designated by the building owner (e.g., a contractor). The alert may contain an estimated-time-to-freeze indication, which can ascertain the urgency of the situation. Additionally, the alert to the building owner may contain targeted offers from contractors.

An alert may be generated if the system detects that the heating system has failed. One way to detect heating system failure may be to monitor the temperature in the building when the thermostat requests for the building to be heated. If the building temperature does not rise as expected, this may indicate a heating system failure. In such an implementation, the alert may be triggered if the condition "$T_t - T_0 < T_m$" occurs. "$T_0$" represents the indoor temperature when the thermostat most recently requested for the building to be heated. "$T_t$" represents the indoor temperature of the building at time "t", which is a certain time after "$T_0$". Time "t" may be building specific. "$T_m$" represents the minimum temperature increase that may be required within the building at time "t" for the alert to not be triggered. $T_m$ may be building specific.

FIG. 1 is a diagram of an overview layout of a context for the present system and approach. A house or other building 11 may have an HVAC system 12 along with a sensor 13 and thermostat 14. Building 11 may also have a water system 15 incorporating a set of pipes 16 for water distribution in building 11.

There may be a cloud 20 that contains electronics 21 for performing logic actions, a memory 22 storing data, and a device 23 for receiving and holding offers. The equipment in cloud 20 may be in a facility and be connected to various components in a wire or wireless manner in absence of a cloud.

Indoor information 25 of building 11 may go to cloud 20 as indicated by an arrow. Information 25 may incorporate indoor temperature, humidity, and heating and cooling demand events of building 11. Other data may also be incorporated in information 25.

Outdoor information 26 of an outdoor world 27 may go to cloud 20 as indicated by an arrow. Information 26 may incorporate current and predicted outdoor temperature, humidity and wind data. Other data may also be incorporated in information 26.

Information 25 and 26 may go to logic electronics 21 via an input 28. Electronics 21 may process information 25 and 26. Some data of information 25 and 26 may be stored in and retrieved from memory 22 via a connection 29. Some of the data in memory 22 may be historical data.

An output 34 from logic electronics 21 may output alerts 35 that indicate pipe freeze conditions in building 11. Alerts 35 may go to a contractor portal 31 from output 34. In response to pipe freeze predictions and indications, offers 32 from a contractor or contractors 36 may go via portal 31 to device 23 for receiving and holding offers. The offers may relate to costs of repairing the failed heating system or damaged items due to pipe-freeze conditions. The offers go from device 23 to logic electronics 21 via an input 33.

Alerts 35 and offers 32, after processing of information 25 and 26 by electronics 21, may go to a consumer or consumers 37 via email, SMS, a portal, or other modes of communication. Consumers 37 may be a person of interest relating to the alerts 35 and offers 32 in that the consumer may own, lease, care-take building 11 or have other responsibilities relative to water system 15 and pipes 16 of building 11. A purpose of the present system and approach is to predict pipe freeze conditions before actual damage of pipes 16 and related components, and/or water system 15.

FIG. 2 is a diagram of a workflow that may predict and/or detect a "pipe freeze" condition. The workflow may be implemented by logic electronics 21 of FIG. 1. Upon a start at symbol 41, a watch for heat failure may be noted at symbol 42. Information such as indoor temperature and a thermostat setting may go from symbol 43 to symbol 42. Also, heat demand information may go from symbol 44 to symbol 42.

Information from symbol 42 may go to a symbol 45 where a question of whether there is a heat failure. Information such as indoor conditions at symbol 46 and outdoor conditions and predictions at symbol 47 may go to symbol 45. If an answer to symbol 45 is no, then a return to symbol 42 where whether a heat failure has occurred, may be asked again. If the answer to the question at symbol 45 is yes, then at symbol 46, an expected time of freeze danger may be calculated. At symbol 47, a question of whether the danger is significant may be asked. A significance of the danger may be determined by comparing the expected time of with a predetermined time. The predetermined time may be empirically or theoretically calculated from various sets of conditions mentioned herein. If the expected time exceeds the predetermined time, then an answer may be no. If the expected time does not exceed the predetermined time, then the answer may be yes. An answer of no to whether the danger is significant at symbol 47 may indicate at symbol 48 a regular "equipment failed" alert. An answer of yes may indicate a "pipe freeze warning" alert at symbol 49.

In the event that the heating in a residence fails, and the outside temperature is lower than the inside temperature, the inside temperature may start to drop due to heat escaping from the house. A formula for future indoor conditions may be as follows:

$$C_i(t)=f(C_{i,0},C_o(t),H);$$

where $C_i(t)$ is the indoor conditions (for example, temperature and humidity) at a time t, which is after the heating is no longer necessarily heating the home; $C_{i,0}$ is the indoor conditions at time 0, which is the time at which the heating stopped heating the home; $C_o(t)$ is the outdoor conditions, including temperature, humidity, wind, and so forth, as a function of time, from time 0 to time t; and H is a set of parameters that describe the relevant properties of the home, such as size, age, and configuration.

When a heating system failure is detected, the present system may calculate the expected indoor temperature trajectory between time 0 (the time of failure detection) and future time t. For this, the present system may use the following data where: $C_{i,0}$ is measured at time 0; $C_o(t)$ is the predicted outdoor weather conditions for the location of the building. This information may be obtained from a variety of external sources. H, the set of parameters, may be estimated from prior observed thermal behavior of the building using a variety of statistical methods.

If a predicted future temperature profile at any time drops below a certain threshold, a "freeze alert" may be generated. The alert may also contain an estimated time or time range at which point the temperature is expected to go below the threshold. In addition, the alert may also contain error margin information indicating the prediction confidence.

To recap, a pipe freeze prediction system may incorporate one or more pipes situated in a building, a heating system for the building, a processor connected to the heating system, a mechanism having a temperature setting for the heating system connected to the processor, an indoor temperature sensor connected to the processor, and a weather information data source connected to the processor. A call may be made for heat if the temperature setting of the mechanism is more than a temperature on the indoor temperature sensor. One or more sensors for determining outdoor conditions, may be connected to the processor. An alert of freeze danger may be provided if the call for heat is unanswered and the outdoor conditions are determined to be freezing according to the one or more sensors and the processor.

One may determine if the freeze danger is significant to result in an alert when a comparison of an expected time of freeze danger with a predetermined time meets a predetermined threshold.

If the freeze danger is absent, then a regular equipment failed alert may be sent out via the processor.

If the freeze danger is present, then a pipe freeze warning alert may be sent out via the processor.

An approach for determining predicting a water pipe freeze prediction, may incorporate watching for a heat failure in a building. If there is no heat failure, then one may continue watching for a heat failure in the building. If there is a heat failure, then one may determine whether temperature conditions outside of the building are freezing. If there is a heat failure, then an expected time of a freeze danger may be calculated, and the expected time of a freeze danger may be compared to a predetermined time to freeze to indicate whether a regular equipment failed alert or a pipe freeze warning alert is to be announced.

The approach may further incorporate determining whether the pipe freeze danger is significant according to a calculated expected time of the freeze danger.

If the freeze danger is not significant, then a regular equipment failed alert may be sent out.

If the freeze danger is significant, then a pipe freeze warning alert may be sent out.

The freeze danger may be significant if the expected time of freeze danger is less than a predetermined time.

The watching for a heat failure, a calculation of the expected time of a freeze danger, an indication of a regular equipment failed alert, or a pipe freeze warning alert may be performed by a processor.

The processor may be situated in a cloud spatially apart from the building.

The cloud may incorporate a first portal for information from the building and about an environment where the building is situated, and a second portal for providing indications of a pipe freeze warning alert and a regular equipment failed alert.

The cloud may incorporate a first portal for receiving information from a thermostat in the building, a second portal for providing alerts to a person having an interest in or a responsibility for the building, and a third portal for providing alerts to one or more contractors or repair people and for receiving one or more offers for repair or maintenance of the one or more contractors or repair people for repair or maintenance of the one or more pipes and heating systems, or for retrieving one or more offers for repair or maintenance from a database. The one or more offers may be provided via the second portal to the person having the interest or the responsibility for the building.

A water pipe freeze condition indicator may incorporate a thermostat in a building where a water pipe freeze condition can be detected, a heating system connected to the thermostat, and a processor connected to the thermostat. The thermostat may provide an indoor temperature, a temperature setting, and heat demand information to the processor. The processor may indicate whether there is a heat demand failure. If there is a heat demand failure, then the processor may calculate an expected time of freeze danger to a water pipe.

The expected time of freeze danger to a water pipe may be compared to a predetermined time to indicate whether a pipe freeze warning alert is to be provided.

If the expected time of freeze danger is less than the predetermined time, then a pipe freeze warning alert may be provided.

If the expected time of freeze danger is equal to or greater than the predetermined time, then a regular equipment failed alert may be provided.

The processor may be situated in a cloud spatially at a distance from the building.

The cloud may incorporate a first portal for information from the building and about an environment where the building is situated, and a second portal for providing indications of a pipe freeze warning alert and a regular equipment failed alert.

The cloud may incorporate a first portal of receiving information from the thermostat, a second portal for providing alerts to a person having an interest in or a responsibility for the building, and a third portal for providing alerts to one or more contractors or repair people and for receiving one or more offers for repair or maintenance of the one or more pipes, or the heating system. The one or more offers may be provided via the second portal to the person having the interest in or the responsibility for the building.

Any publication or patent document noted herein is hereby incorporated by reference to the same extent as if each publication or patent document was specifically and individually indicated to be incorporated by reference.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A pipe freeze prediction system comprising:

one or more pipes situated in a building;

a heating system for the building;

a mechanism having a temperature setting for the heating system;

an indoor temperature sensor for sensing climate conditions inside the building;

one or more sensors for sensing climate conditions outside the building; and a processor operationally coupled to the heating system, the mechanism, the indoor temperature sensor, and the one or more sensors, the processor configured to:

make a call to the heating system for heat if the temperature setting of the mechanism is more than a temperature sensed by the indoor temperature sensor;

monitor a sensed temperature in the building using the indoor temperature sensor in response to the call to the heating system for heat;

determine if the call for heat is answered based at least in part on the monitoring of the sensed temperature;

receive indoor information related to conditions inside the building using the indoor temperature sensor and outdoor information related to conditions outside the building using the one or more sensors in response to determining the call for heat is unanswered;

process the indoor information and the outdoor information to perform a trajectory analysis;

determine an expected freezing time based at least in part on the trajectory analysis; and send out an alert based on the expected freezing time.

2. The system of claim 1, wherein the trajectory analysis is used to calculate a temperature trajectory and the processor determines to send out a regular alert when the temperature trajectory is above a temperature threshold during a predetermined amount of time and determines to send out a danger alert when the temperature trajectory falls below the temperature threshold during the predetermined amount of time.

3. The system of claim 1, wherein if the expected freezing time does exceed a predetermined time, then a regular equipment failed alert is sent out via the processor.

4. The system of claim 1, wherein if the expected freezing time does not exceed a predetermined time, then a pipe freeze warning alert is sent out via the processor.

5. A method for determining predicting a water pipe freeze prediction, comprising:

watching for a heat failure in a building; and wherein:

if there is no heat failure, then continue watching for a heat failure in the building;

if there is a heat failure, then determine whether temperature conditions outside of the building are freezing; or if there is a heat failure, then an expected time of a freeze danger is calculated, and the expected time of a freeze danger is compared to a predetermined time to freeze to indicate whether a regular equipment failed alert or a pipe freeze warning alert is to be announced;

the watching for a heat failure, a calculation of the expected time of a freeze danger, an indication of a regular equipment failed alert, or a pipe freeze warning alert is performed by a processor;

the processor is situated in a cloud spatially apart from the building;

the cloud comprises:

a first portal for receiving information from a thermostat in the building;

a second portal for providing alerts to a person having an interest in or a responsibility for the building; and a third portal for providing alerts to one or more contractors or repair people and for receiving one or more offers for repair or maintenance of the one or more contractors or repair people for repair or maintenance of the one or more pipes and heating systems, or for retrieving one or more offers for repair or maintenance from a database; and wherein the one or more offers are provided via the second portal to the person having the interest or the responsibility for the building.

6. The method of claim 5, further comprising determining whether the pipe freeze danger is significant according to the calculated expected time of the freeze danger.

7. The method of claim 6, wherein if the freeze danger is not significant, then a regular equipment failed alert is sent out.

8. The method of claim 6, wherein if the freeze danger is significant, then a pipe freeze warning alert is sent out.

9. The method of claim 6, wherein the freeze danger is significant if the expected time of freeze danger is less than a predetermined time.

10. The method of claim 5, wherein a first portal is further configured to transmit information from the building and about an environment where the building is situated; and a second portal is further configured to transmit indications of a pipe freeze warning alert and a regular equipment failed alert.

11. A water pipe freeze condition indicator comprising:

a thermostat in a building where a water pipe freeze condition can be detected;

a heating system connected to the thermostat; and a processor situated in a cloud spatially at a distance from the building and connected to the thermostat; and wherein the cloud comprises:

a first portal of receiving information from the thermostat;

a second portal for providing alerts to a person having an interest in or a responsibility for the building; and a third portal for providing alerts to one or more contractors or repair people and for receiving one or more offers for repair or maintenance of the one or more pipes, or the heating system; and wherein the one or more offers are provided via the second portal to the person having the interest in or the responsibility for the building; and wherein:

the thermostat provides an indoor temperature, a temperature setting, and heat demand information to the processor;

the processor indicates whether there is a heat demand failure; and if there is a heat demand failure, then the processor calculates an expected time of freeze danger to a water pipe.

12. The indicator of claim 11, wherein the expected time of freeze danger to a water pipe is compared to a predetermined time to indicate whether a pipe freeze warning alert is to be provided.

13. The indicator of claim 12, wherein if the expected time of freeze danger is less than the predetermined time, then a pipe freeze warning alert is provided.

14. The indicator of claim 12, wherein if the expected time of freeze danger is equal to or greater than the predetermined time, then a regular equipment failed alert is provided.

15. The indicator of claim 11, wherein:

the first portal further receives information from the building and about an environment where the building is situated; and the second portal further provides indications of a pipe freeze warning alert and a regular equipment failed alert.

* * * * *